United States Patent [19]

Broll et al.

[11] Patent Number: 4,830,236

[45] Date of Patent: May 16, 1989

[54] DIVIDED VALVE

[75] Inventors: Josef Broll, Ratingen; Heinz Freckmann, Duesseldorf, both of Fed. Rep. of Germany

[73] Assignee: Benz & Hilgers GmbH, Duesseldorf, Fed. Rep. of Germany

[21] Appl. No.: 109,985

[22] Filed: Oct. 16, 1987

[30] Foreign Application Priority Data

Nov. 4, 1987 [DE] Fed. Rep. of Germany ..... 3627550

[51] Int. Cl.[4] ..... B65D 47/00

[52] U.S. Cl. ..... 222/485; 222/330; 222/5 03; 141/163; 251/212

[58] Field of Search ..... 222/380, 481, 482, 484, 222/485, 502–5 04, 255, 275–277, 330; 141/163, 167, 180, 183; 251/212

[56] References Cited

U.S. PATENT DOCUMENTS

| | | | |
|---|---|---|---|
| 3,176,729 | 4/1965 | Steiner | 141/360 X |
| 3,235,134 | 2/1966 | Frye | 222/503 X |
| 3,530,636 | 9/1970 | Weprin et al. | 141/167 X |
| 4,235,265 | 11/1980 | Feliks | 141/85 |
| 4,254,806 | 3/1981 | Elsworth | 222/380 X |
| 4,373,560 | 2/1983 | Elsworth | 222/484 X |
| 4,460,025 | 7/1984 | Scholle et al. | 141/1 |

FOREIGN PATENT DOCUMENTS

| | | |
|---|---|---|
| 2359522 | 6/1975 | Fed. Rep. of Germany . |
| 3002009 | 7/1981 | Fed. Rep. of Germany . |

*Primary Examiner*—Michael S. Huppert
*Attorney, Agent, or Firm*—Klein & Vibber

[57] ABSTRACT

An arrangement havign a closing member for filling mouthpiece of a filling machine for filling material of a pasty up to a chunky or lumpy consistency, whereby during the filling packaging containers are stepwise moved underneath the filling mouthpiece. When the filling material is very tough and hardens rapidly, it is desirable that the heap-like remanent tip Z of the filling material, which remains after the filling operation,is disposed in the middle of each packaging container. This achieved by means of a closing member that includes two identical oppositely rotatably movable cylinders, each one of which is provided with a rectangular recess. These recesses extend to each one of the cylinders in such a way that a disc-shaped base portion and a shank remain, which shank has a circular segment-shaped cross-section. The cylinders are mounted in a bore which is transverse to the longitudinal axis of the filling mouthpiece and are mutually coaxially arranged and are positioned in such a way that the shank of one cylinder extends into the recess of the other cylinder. The cylinders move jointly and in synchronization with the packaging container therepast and are actuated for achieving an opening and closing motion. In the open position the inner sides of the shanks align with the filling channel of the filling mouthpiece. In the closed position the edges of the shanks precisely meet at the longtiduinal aixis of the filling mouthpiece and thereby pinch off the filling material.

7 Claims, 6 Drawing Sheets

DIVIDED VALVE

BACKGROUND OF THE INVENTION

The invention relates to an arrangement for a closing member for a filling mouth of a filling machine.

The invention relates to an arrangement in which a closing member for a filling mouth having a filling channel in a filling machine for pastry and/or lumpy material of the food industry, such as butter, margarine, gourmet salads, mayonnaise and similar food products. The arrangement of the invention is provided with a bore which is perpendicularly disposed with respect to the filling axis of the filling mouth in which the closing member is rotatably mounted.

Such closing members generally form the lower end of the filling mouthpiece, below which the packaging container, for example a cup, is moved laterally on a transportation band in synchronization with the operation of the machine. (See, for example, West-German published patent application Nos. DE 30 02 009 and 23 59 522). As soon as a packaging container has come to a stillstand, the closing member is opened for the purpose of permitting the filling material to pass therethrough and thereby to fill the container. After the filling process has been terminated, the closing member seals itself and the transportation band advances one operative step until the next empty packaging container is presented in confrontational relationship to the filling mouthpiece. The opening and closing of the closing member is effected by means of cam discs or by means of piston cylinder units that operate with pressurized air via a rod linkage in synchronization with the containers that are advanced therepast.

It is known to use filling mouthpieces in filling machines for filling material having pasty and up to lumpy consistency which are provided with a so-called "stop cock" as a closing member. Filling mouthpieces of the afore-described type are provided with filling channels through the geometric center of which there extends a filling axis. By means of this filling channel the filling material of pasty up to chunky or lumpy consistency can be transported. There is provided in the filling mouthpiece a bore that extends laterally to the filling axis. This bore forms the housing for the stop cock in which the aforementioned cock is rotatably mounted. The cock proper includes a bore which extends transversely to its longitudinal axis. This bore coincides, insofar as its size is concerned, to the diameter of the filling channel of the filling piece and is arranged in such a way that it is in alignment with the filling channel. When such alignment is present, the closing member is opened and the filling material can flow therethrough into the packaging container. The closing member is then closed when the cock is turned 90°. In this position the bore of the cock is disposed transversely to the filling channel and the imperforate portion of the cylindrical surface of the cock seals against the bore wall of the cock housing.

Such a closing member fulfills in most cases its purpose. However, by means of its closing movement, as a result of the rotational motion of the cock, the outwardly flowing filling material is displaced at the end of the sealing process to that edge of the filling channel which is disposed in the rotational direction, in which the opening which is being closed, becomes first of all continuously smaller and finally disappears completely. As a result of such closing operation there is formed at the edge of the packaging container a displaced tip of remanent pasty filling material which forms a heap or tip like protrusion at the edge of the container on the upper surface of the filling material. It has been attempted to avoid this phenomenon by means of an eccentric stop position of the packaging container relative to the filling mouthpiece to thereby displace the remanent filling material tip away from the edge of the container. These attempts of improving the arrangement did not achieve the desired results because during the beginning of the filling process a filling material heaping at the container edge was observed. In particular when the filling material is very tough or solidifies after the filling operation a smoothing out of the filling material's upper surface can later on no longer occur. Such a filling material heaping at the container edge is to be avoided because of the possible contacting of the filling material on the container edge is to be avoided for aesthetic reasons alone.

SUMMARY OF THE INVENTION

The invention has as its object to provide an arrangement with a closing member of the afore-described type so that the filling material is located in the middle of the packaging container and at the end of the filling process the unavoidable remanent tip or heap of the pasty filling material is made smaller and is located as closely as possible in the middle of the packaging container.

In order for the closing container to function in the desired manner, the dimensions of the circularly shaped base portion thereof, the height of the circular segment in crosssection of the shanks and the length of the shanks are advantageously dimensioned. In a modified embodiment of the invention the cylinders are mounted on support trunnions and pivot-levers and are rotatably oppositely driven in such a way that for purposes of obtaining an open position, respectively a closed position, during the same intervals the same angular movements are traversed. In the closed position the edges of the shanks, which in cross-section are circularly segment-shaped, contact each other precisely at the filling axis.

All of the afore-mentioned inventive features assure that the unavoidable tip of the filling material remains as small as possible, because the filling material, as a result of the rapid mutual movement towards each other of the shank edges is quasi instantaneously cut off; the remanent tip of the filling material in addition thereto is, as desired, located in the middle of the packaging containers, because the edges of the shanks meet exactly each other at the filling axis.

A double lever having identical arms is provided which via a rod-linkage and lifting lever, drives the pair of cylinders of the arrangement. Thereby, without any large input, the identical yet opposite movement of the cylinders is attained. The double lever for driving the cylinders possesses a suitable drive, preferably a cam with a cam follower, whereby in a simple manner the opening and closing movement of the cylinder is synchronized with the movement of the packaging container underneath the filling mouthpiece.

In a further embodiment of the invention a plurality of closing members, mounted one behind the other, are jointly driven via a further linkage. Such an arrangement is advantageous because additional control and drive mechanisms can be dispensed with while the filing capacity is, however, multiplied.

BRIEF DESCRIPTION OF THE DRAWINGS

These and other objects, features and advantages of the present invention will become more obvious from the following description when taken in connection with the accompanying drawings, in which.

DETAILED DESCRIPTION

Figure 1:
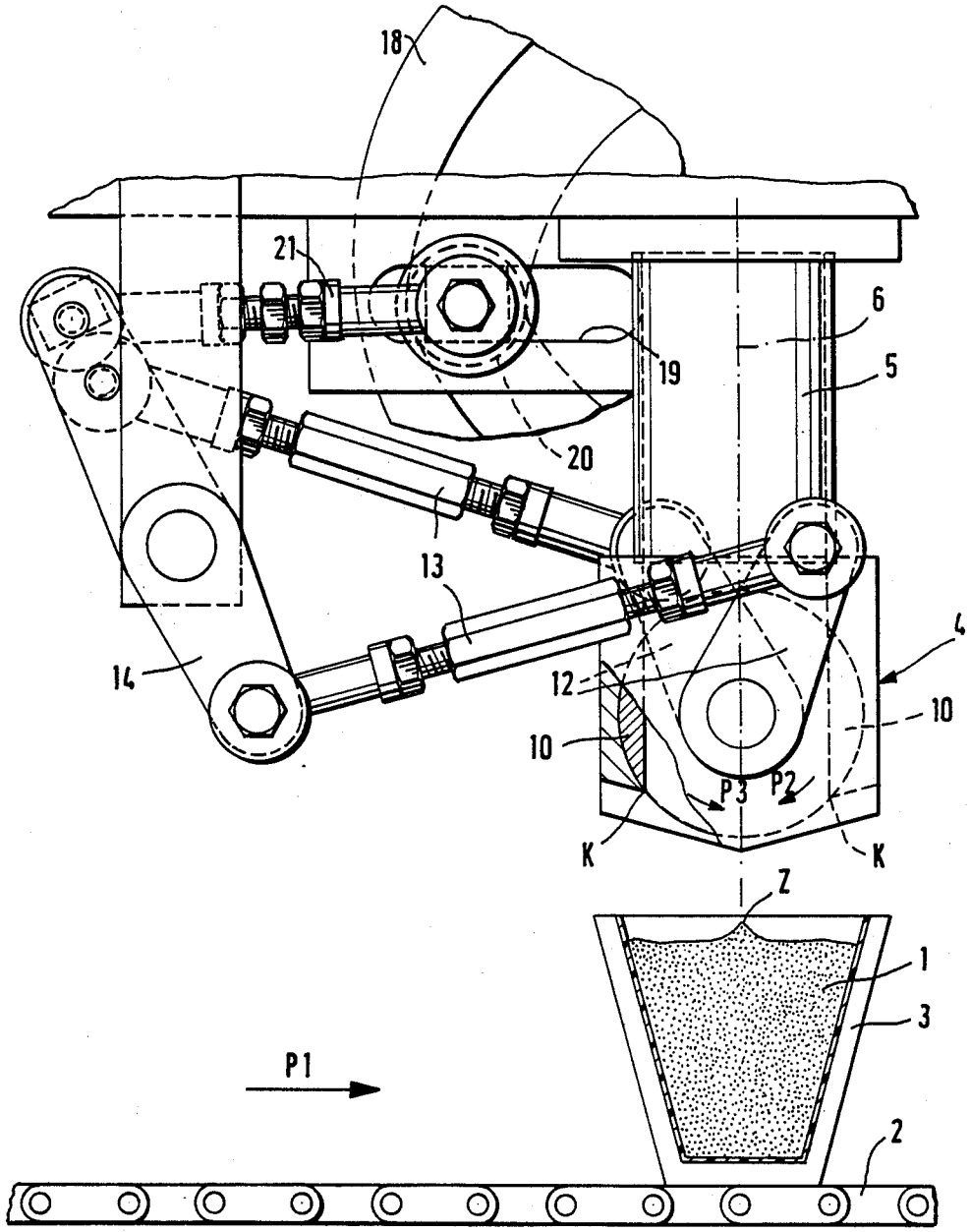
FIG. 1 is a side-elevational view of the closing member with the diving parts thereof, partially in cross-section, shown in the open position.
Figure 2:
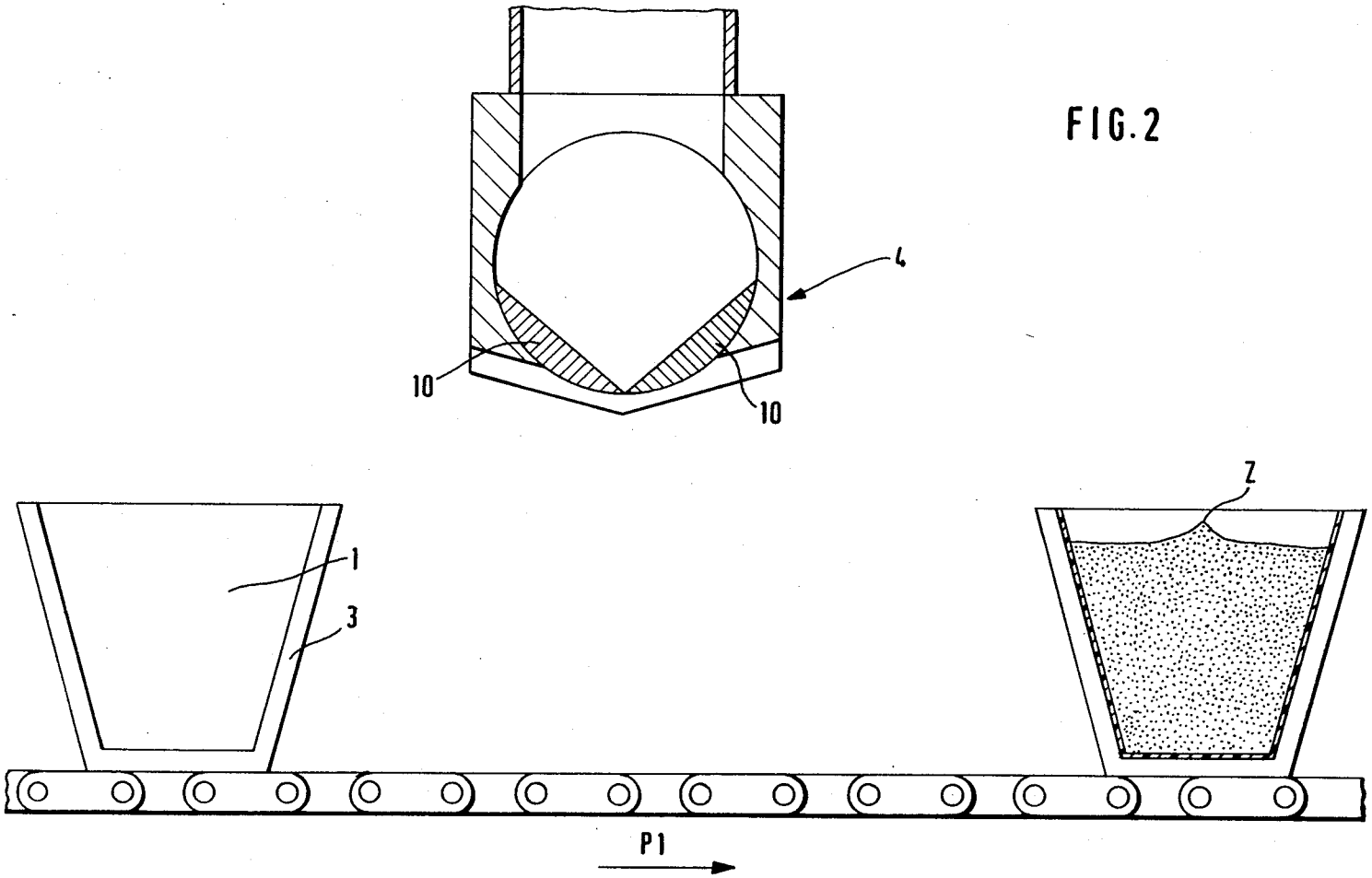
FIG. 2 illustrates a detail of the arrangement of FIG. 1 which shows the closing member in cross-section and in the closed position.
Figure 3:
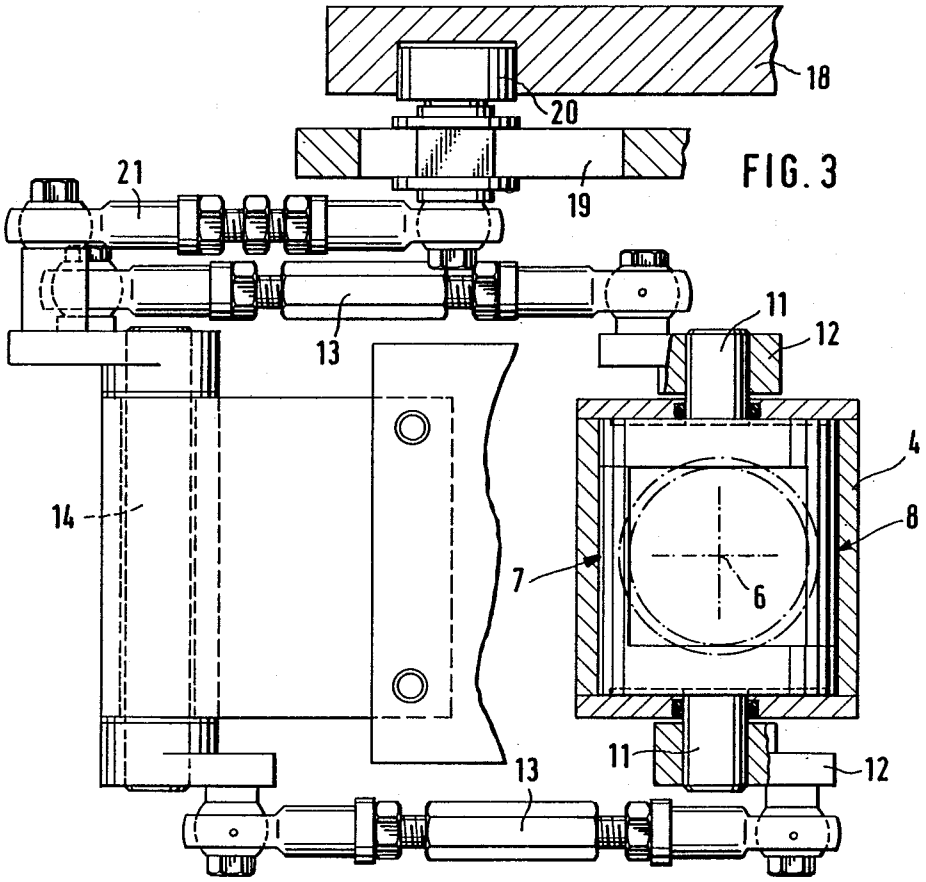
FIG. 3 is a plan view of the arrangement shown in figure 1.

As can be seen from FIGS. 1 and 2 the packaging container 1 is stepwisely advanced by means of a transportation chain 2 in the direction of the arrow P1 and arrives under a filling mouthpiece 4. The packaging container 1 is mounted in a holder 3 which is connected to the transportation chain 2 and thereby is held securely in an operative position. A closing member of the filling mouthpiece 4 opens at the instant when the packaging container 1 has reached a standstill position immediately underneath the filling mouthpiece 4 and closes after having delivered a dosed amount of filling material which ends the filling process. Thereafter, the next packaging container is moved in a stepwise synchronized manner underneath the filling mouthpiece 4.

Figure 4:
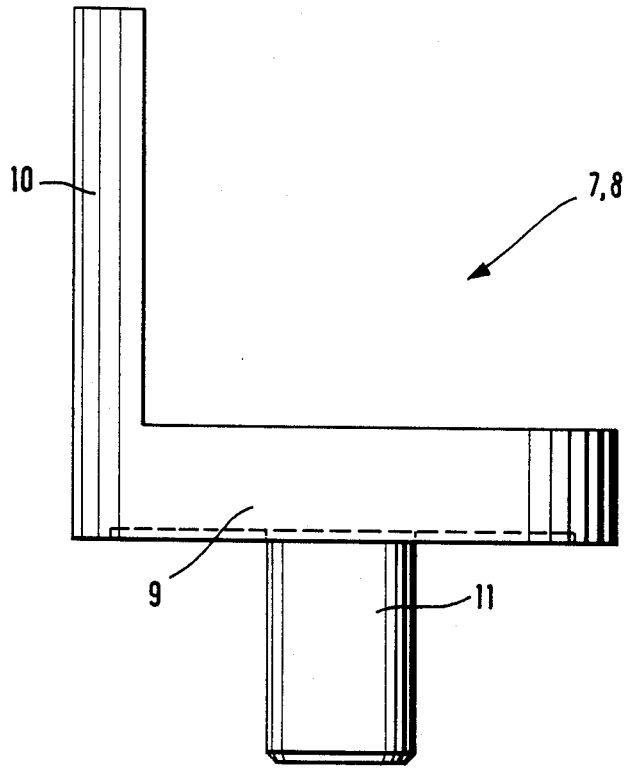
FIG. 4 illustrates a cylinder of the arrangement together with its recess.

The filling mouthpiece 4 is secured to the lower end of a filling pipe 5. The filling pipe 5 extends with its upper end to a non-illustrated storage container for the filling material. The storage container, filling pipe 5 and filling mouthpiece 4 jointly form the essential parts of a filling arrangement in a filling machine of the aforedescribed type. A filling axis 6 extends concentrically and coaxially with respect to the filling pipe 5 and the therefrom downwardly extending filling mouthpiece 4. The latter includes a filling channel of preferably square cross-section; the length of each side of the square corresponds about to the bore diameter of the filling pipe 5. The filling axis 6 thus forms the geometric center of the square. In the filling mouthpiece 4 there is provided, perpendicularly to the filling axis 6, a bore for receiving a closing member. This bore has a larger diameter than the bore diameter of the filling pipe 5. The closing member itself consists essentially of two identical cylinders 7, 8, each one of which is provided with a rectangular recess, which extends through the cylinder so that a disc-like base portion 9 and a shank portion 10, which has a circular segmented-shaped cross-section, remains. FIG. 4 illustrates in detail such a cylinder 7 or 8 with its recess. As can be seen in FIG. 4, the base portion 9 has an axial height which is about 1/6 to ¼ of the cylinder diameter. The height of the circular segmented shaped crosssection is about half the difference between the diameter of the cylinder and the width of the flow-through cross-section of the filling channel of the filling pipe 5. The length of the shank position 10 corresponds about to the width of the filling channel.

In the bore for the closing member, the cylinders 7, 8 are mutually disposed in such a way that at all times the shank 10 of the cylinder 7 extends into the recess of the cylinder 8, respectively the shank 10 of the cylinder 8 extends into the recess of the cylinder 7. The cylinders 7, 8 are rotatably mounted and are driven by a double-armed lever 14, the arms of which are identical. The driving by means of the double-armed lever 14 is effected via the trunnion pin 11, the driving lever 12 and the rod 13. The double lever 14 receives its driving energy from a suitable driving mechanism, preferably by means of a cam-disc 18, in the cam path of which a roller 20 is guidingly mounted. The roller 20 is seated on a bolt which is reciprocally guided in a straight slot 19 and which is connected to the rodlinkage 21. The so-formed drive linkage transfers a reciprocatory movement to the rod-linkage 21. The control of the drive is provided in such a way that at the instant when a packaging container is positioned underneath the filling mouthpiece 4, the closing member 7, 8 is opened. In this instant the inner side of the shank 10 aligns with the inner side of the filling mouthpiece 4. Such open position is illustrated in FIG. 1.

After the filling process has been completed, the aforementioned driving arrangement for the cylinder 7, 8 are moved in the direction of the arrows P2, P3 towards each other, so that the lower edges K of the shanks 10 meet exactly at the filling axis 6. Such a closed position is illustrated in FIG. 2. The so-constructed closing member provides a central filling of a packaging container 1 and moreover ensures that the remanent tip Z remains in the middle of the packaging container. The application of a double-lever 14 with identical arms in conjunction with the rod-linkage 13 as driving means ensures an identical-opposite motion of the cylinder 7, 8.

Figure 5:
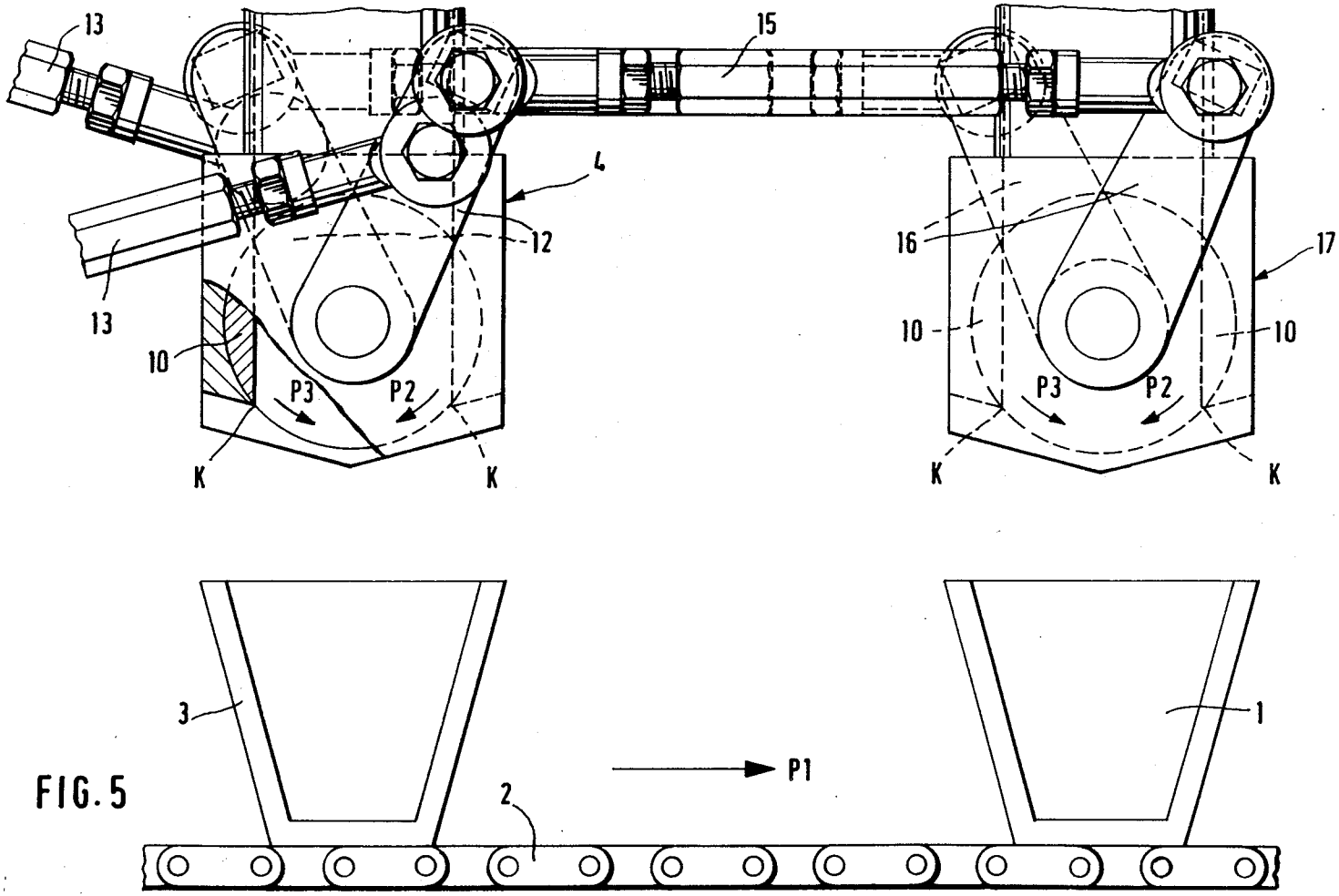
FIG. 5 is a side-elevational view of two closing members which are drivingly connected to each other.
Figure 6:
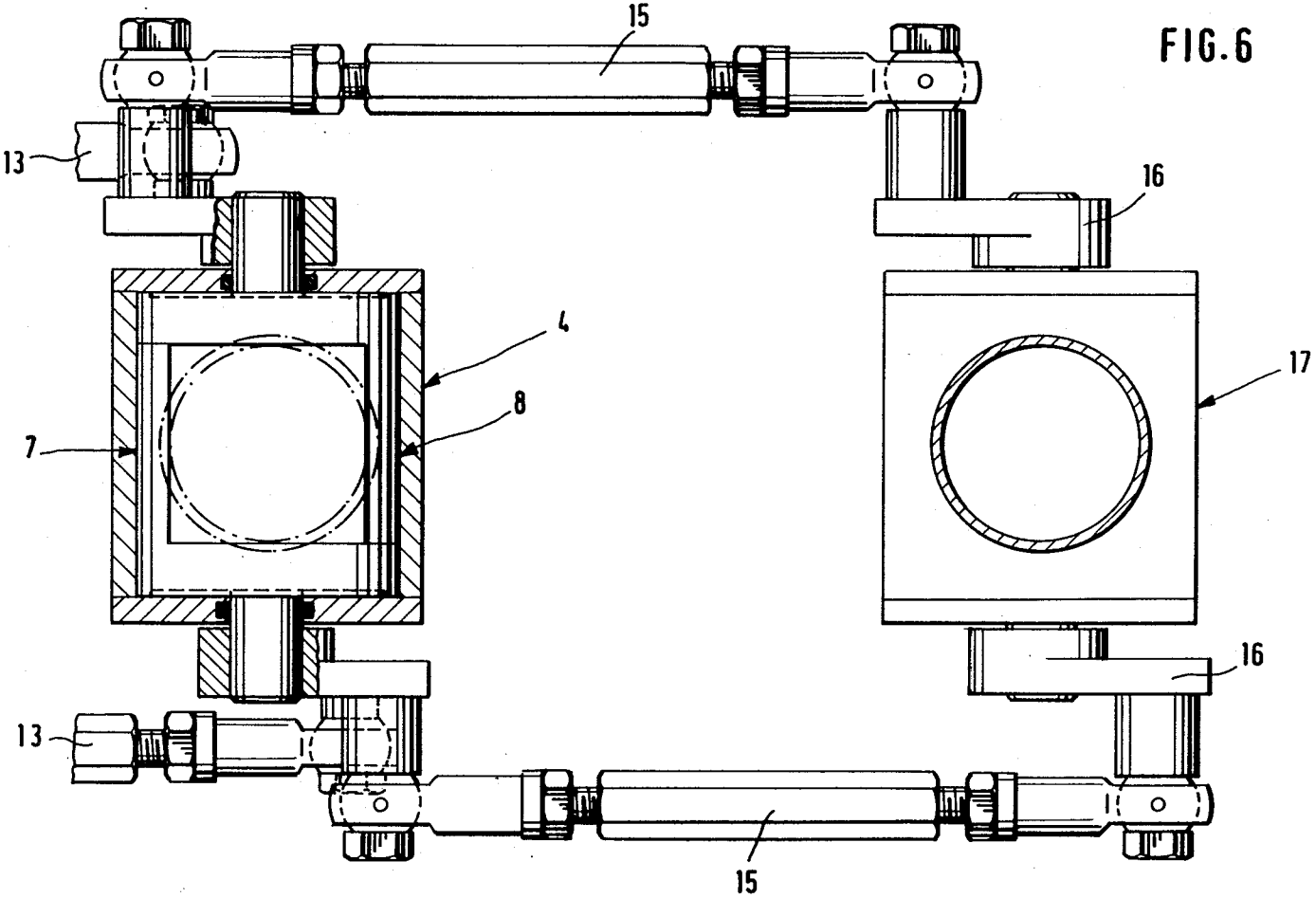
FIG. 6 is a plan view of the arrangement of FIG. 5.

FIGS. 5 and 6 illustrate a further embodiment of the invention, wherein two identical closing members are mounted one behind the other. The closing member of a second filling mouthpiece 17 is driven by the closing member of the first mouthpiece via a rod-linkage 15 and a control lever 16. In such an arrangement the additional control elements can be dispensed with and the filling output capacity be doubled. It is, of course, understood that more than two identical closing members can be arranged in a similar manner which would correspondingly increase the savings of the machine elements and the filling output capacity of the arrangement.

Although a limited number of embodiments of the invention have been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

We claim:

1. In a filling machine for dispensing pasty and/or chunky food material into containers having an improved filling mouthpiece with a filling channel which moves in synchronization with the operation of a transportation band moving underneath said mouthpiece, which filling mouthpiece has a transversely extending bore in which a closing member is rotatably mounted, the improvement comprising in combination, said closing member comprising a pair of analogous, oppositely rotating coaxially arranged cylinders, each one of said cylinders having a rectangular recess which extends transversely relative to the corresponding cylinder axis, each cylinder with its corresponding recess being constructed in such a way that the recessed cylinders are shaped as a coaxial disc with a shank portion having substantially circular segment shape in cross-section; said shank portion of each coaxial disc of each cylinder extending into the rectangular recess of the opposite coaxially arranged cylinder.

2. The improvement in a filling mouthpiece of a filling machine for dispensing pasty and/or chunky food material into containers as defined in claim 1, wherein (a) said disc has an axial height of 1/6 to ¼ the cylinder diameter;

(b) the height of said circular segment shape in cross-section being about half the difference between the diameter of the cylinder and the width of the flow-through cross-section of said filling channel of the filling mouthpiece; and (c) the length of said shank portion corresponds to about the width of said filling channel of the filling mouthpiece.

3. The improvement in a filling mouthpiece of a filling machine for dispensing pasty and/or chunky food material into containers as defined in claim 2, wherein each one of said pair of cylinders is rotatably mounted by means of a support pin coaxially extending from said disc and by linkage means in such a way that said pair of cylinders rotate simultaneously in mutually opposite directions from an open to a closed position and vice-versa and traverse identical angular ranges during such movement.

4. The improvement in a filling mouthpiece of a filling machine for dispensing pasty and/or chunky food material into containers as defined in claim 3, wherein each one of said shank portion has a lower edge (K), said edges contact each other exactly at the axis of the filling channel when said cylinders are in said closed position.

5. The improvement in a filling mouthpiece of a filling machine for dispensing pasty and/or chunky food material into containers as defined in claim 4, wherein said linkage means include a double-armed lever and a pair of identical rods each one of which is pivotally connected, at one of its end to one arm of said double-armed lever and at the other one of its ends to a drive lever which is rigidly connected to said support pin of said disc.

6. The improvement in a filling mouthpiece of a filling machine for dispensing pasty and/or chunky food material into containers as defined in claim 5, including cam disc and cam disc follower driving means operatively connected to said double-armed lever.

7. The improvement in a filling mouthpiece of a filling machine for dispensing pasty and/or chunky food material into containers as defined in claim 6, wherein at least two analogous filling mouthpieces are operatively mounted one behind the other and are jointly driven by said linkage means.

* * * * *